US006918651B2

(12) United States Patent
Menendez et al.

(10) Patent No.: US 6,918,651 B2
(45) Date of Patent: Jul. 19, 2005

(54) SCAN AXIS ASSEMBLY FOR A PRINTER

(75) Inventors: Jorge Menendez, Barcelona (ES); Marcelo Ymbern, Barcelona (ES); Francesc Subirada, Castellbisbal (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 46 days.

(21) Appl. No.: 10/424,423

(22) Filed: Apr. 28, 2003

(65) Prior Publication Data

US 2003/0227511 A1 Dec. 11, 2003

(30) Foreign Application Priority Data

Apr. 27, 2002 (GB) ..... 0209699

(51) Int. Cl.[7] ..... B41J 23/00
(52) U.S. Cl. ..... 347/37
(58) Field of Search ..... 347/37, 40, 43; 400/283, 294.2, 296.2, 304

(56) References Cited

U.S. PATENT DOCUMENTS

| | | | |
|---|---|---|---|
| 5,330,274 | A | 7/1994 | Schimmelpfennig et al. |
| 5,670,995 | A | 9/1997 | Kupcho et al. |

FOREIGN PATENT DOCUMENTS

| | | | |
|---|---|---|---|
| EP | 0359580 | B1 | 6/1993 |
| EP | 0571804 | B1 | 3/1996 |
| EP | 0622757 | B1 | 7/1999 |
| EP | 1184188 | A2 | 3/2002 |
| JP | 4201363 | A | 7/1992 |
| JP | 5261978 | A | 10/1993 |

*Primary Examiner*—Lamson Nguyen
(74) *Attorney, Agent, or Firm*—Foley & Lardner LLP

(57) ABSTRACT

A scan axis assembly for a printer comprises first and second tracks, the tracks being rigidly located relative to one another by one or more track support members, and each track being arranged to support a print carriage such that the print carriage may move along the track to traverse a print zone.

41 Claims, 7 Drawing Sheets

SCAN AXIS ASSEMBLY FOR A PRINTER

CROSS-REFERENCE TO RELATED PATENT APPLICATIONS

GB Priority Application 0209699.8, filed Apr. 27, 2002 including the specification, drawings, claims and abstract, is incorporated herein by reference in its entirety.

FIELD OF THE INVENTION

This invention relates to printers having printing elements which are scanned along a scan axis relative to a print medium. The invention has particular application to printers such as inkjet printers in which a print carriage carrying one or more printheads is scanned along a scan axis to print an image in swaths between advances of the print medium relative to the scan axis.

BACKGROUND OF THE INVENTION

Increased printing speeds are continually sought by users of printers, and there is therefore an ongoing desire by printer manufacturers to provide increased printing speeds. This is addressed in many ways, including improvements in software and firmware, improvements to the printing elements themselves (such as the speeds attainable by inkjet printheads) and improvements in the speed at which the moving parts of the printer can reliably move while maintaining the necessary accuracy of the printheads relative to the print medium.

The Hewlett Packard DesignJet 5000 is an example of a typical high quality inkjet printer. Inside the print body a scan axis comprising a track is mounted, and a print carriage scans along the track between incremental paper (or other print medium) advances. The print carriage has three bushings mounted on rails of the track, and a drive mechanism causes the carriage to be traversed back and forth while firmware within the printer converts received image files to swaths of halftone pixels in six colours. The firmware converts these halftone swaths to firing instructions for individual nozzles in a set of six printheads each provided on a print cartridge held on the carriage.

In high quality print modes, the swath is laid down in overlapping multiple passes. One of the reasons for employing higher numbers of passes is that in an eight pass print mode, for example, each pass lays down approximately ⅛th of the ink in a given area and thus each droplet laid down has an opportunity to dry before the next adjoining or overlapping droplet reaches the print medium. There is however a trade-off in that the printing speed of an eight-pass print mode is approximately eight times less than a single pass mode to achieve better print quality.

A further problem which arises in printing high quality textiles for example, is that a conventional CcMmYK set of six inks (comprising cyan, light cyan, magenta, light magenta, yellow and black) may not give sufficient colour fidelity. While one solution is to add additional ink colour cartridges to the print carriage, this results in a carriage which is larger than before. The scan axis or chassis along which the carriage travels will not be truly straight, and as a carriage travels along a non-linear scan axis, the increased length of the carriage will lead to greater errors in positioning droplets from different pens on the carriage.

It would therefore be desirable to provide a scan axis assembly which enables increased printing speeds to be attained. It also aims to provide improved printers and methods of manufacture of printers and their constituent parts.

SUMMARY OF THE INVENTION

The invention provides a scan axis assembly for a printer comprising first and second tracks, the tracks being rigidly located relative to one another by one or more track support members, and each track comprising a rail support member and at least one rail mounted on the rail support member to support a print carriage such that the print carriage may move along the rail to traverse a print zone.

The invention enables the track support members to fix the positions of the tracks relative to one another in a general sense, while a carriage-supporting rail on one track can be very accurately positioned relative to a carriage-supporting rail on the other track. This is of particular importance where the two print carriages are for printing on the same medium, so that the printing actions performed by the two carriages are very accurately aligned with respect to one another.

Preferably, the one or more track support members comprise a pair of frame members spaced apart from one another along a scan axis direction, said first and second tracks spanning said frame members and lying along said scan axis direction parallel to one another, whereby said frame members maintain the spacing between said parallel tracks when assembled in a printer.

By providing two parallel axes the printing throughput can surprisingly be more than doubled. The twin tracks provide a pair of scan axes for two print carriages and the carriages thus have parallel and offset print areas. The printer therefore prints two swaths simultaneously and in multiple pass print modes, each print carriage will print half of the total number of passes specified by the print mask.

Thus if each print carriage prints its swath (containing half of the droplets required in the full image) in two passes (so each pass lays down one quarter of the droplets), the printer will operate at the same speed as a conventional printer in two-pass mode (the processing power is increased to allow the image to be processed for the two scan axes), but will in fact utilise what is effectively a four pass print mask. However the print quality will be better than conventional four pass print mode output.

The reason for this unexpected increase in quality is that because the two print zones are spaced apart from one another on the print medium the ink will have an opportunity to dry between the print zones. Thus, the final swath will be of equivalent quality to a hypothetical four pass print mode image in which the print carriage and paper advance mechanism is paused between the printing of the first two passes and the second two passes (this hypothetical pause being equivalent to the time taken for a point on the page to advance from the first print zone to the second print zone).

The invention is not of course limited to two parallel scan axes; three, four or even more parallel tracks, each for supporting a print carriage can be employed by extension.

Preferably, two or more rails are mounted on the rail support member of each track.

Further, preferably, each frame member comprises a locating point for accurately locating one rail of one track to that frame member.

As will be explained further below, the accurate location of one particular rail with respect to each frame member allows that rail to be used as a datum point for the location of the other elements of the assembly.

Thus, in a preferred embodiment each frame member comprises means for adjustably affixing the tracks to the frame member, whereby when said one rail of one track is located at the locating point the distance between the tracks can be adjusted before the other track is affixed to the frame member.

Preferably, the first track is accurately located on each frame member, while the second track is affixed to both frame members when it has been positioned a predetermined distance from the first track. In this way the tracks are kept accurately parallel and are held parallel by the frame members.

Suitably the locating point may comprise a "V"-shaped recess which receives said rail. The rail can be typically a round bar which is uniquely located when it sits in the internal angle of the V.

Preferably, each frame member comprises a support structure for supporting each of the rails not located at said locating point. Thus, in a two track assembly, with two rails per track, each frame member will preferably have one locating point (for one rail of one track) and three support structures for supporting but not for accurately locating the other three rails.

Preferably, each frame member comprises a plate having a central aperture for receiving said tracks, said locating point and said support structures extending into said aperture for receiving the rails, and means for affixing the rail support members of the tracks to the opposed internal faces of the plates when the rails are located on the locating point and the support structures.

Further, preferably, said plate is generally "C"-shaped such that the aperture is open to the external periphery of the plate.

In the preferred embodiment of assembly, one end of each track extends beyond one of the frame members by a distance at least equal to the width of the carriage, whereby the carriage may be traversed along the track past the frame member to allow access to or maintenance of the carriage.

Preferably, the first and second tracks extend beyond the frame members as aforesaid at opposite ends.

In this way there are two maintenance stations, one adjacent to each frame member for accessing one of the two print carriages. Such maintenance stations may be used for e.g. removing the carriage from the track, cleaning the printheads, or replacing or adjusting the print cartridges on the print carriage.

Preferably, the first and second tracks are provided with stops against which the frame members are mounted. Where the tracks comprise an extrusion, part of the extrusion can be stripped away to leave a stop surface against which the frame members abut and to which the frame members can be affixed.

Preferably, the rail support members of the tracks are manufactured to a first tolerance below that required for accurate positioning of a print carriage in use, but comprise a rail mounting feature manufactured to a second tolerance at least equal to that required for accurate positioning of a print carriage in use, the rails being affixed to the rail mounting feature and the rails being adapted to receive the print carriage.

This is advantageous in view of the fact that the rail support members of the tracks, being extended generally linear structures, are most conveniently manufactured by extrusion processes. However, the tolerances achievable by conventional extrusion for e.g. an aluminium extrusion, are of the order of 1 mm per meter. If the print area has a width of e.g. 1.6 m the tolerances may give rise to lateral variations of 1.6 mm along the length of the scan axis.

However, by making the rail support member according to this first tolerance (e.g. by extrusion) and then accurately machining a rail mounting feature into the extrusion, the tolerances of the rail mounting feature can be improved tenfold using conventional machining techniques at a reasonable cost.

Preferably, the rail mounting feature comprises a pair of parallel accurately machined grooves on each rail support member, each groove being adapted to receive a respective rail of the track.

In another aspect the invention provides a printer comprising a scan axis assembly according to the invention.

Preferably, the printer will also comprise a print medium advance mechanism for advancing a print medium past the scan axis assembly, and a print carriage traverse mechanism for causing a pair of print carriages mounted on the tracks of the scan axis assembly to traverse the tracks and thereby enable the printing of swaths on the print medium.

In a further aspect, the invention provides a method of manufacturing a scan axis assembly for a printer, comprising the steps of:

a) affixing a first linear track adapted to receive a print carriage to a first frame member;

b) affixing a second linear track adapted to receive a print carriage to said first frame member such that the points of attachment of the tracks to the first frame member are separated by a predetermined distance and the tracks are positioned generally parallel to one another;

c) affixing one of the first and second tracks to a second frame member such that the first and second frame members are spaced apart from one another along the direction of the tracks; and d) affixing the other of the first and second tracks to the second frame member such that the points of attachment of the tracks to the second frame member are separated by said predetermined distance and the tracks are accurately positioned parallel to one another to define parallel scan axes for a pair of print carriages each mounted on a respective one of said tracks.

Preferably, step (a) comprises locating one rail of the first track at a locating point provided on the first frame member prior to affixing the first track to the first frame member.

Preferably, step (b) comprises employing a spacing template to separate the second track from the first track by said predetermined distance before affixing the second track to the first frame member.

Preferably, step (c) comprises locating one rail of said one of the tracks at a locating point provided on the second frame member prior to affixing said one of said tracks to the second frame member.

Preferably, step (d) comprises employing a spacing template to separate said other track from said one track by said predetermined distance before affixing said other track to the second frame member.

A relatively simple hardened steel template can be used at both ends to ensure that the tracks are equally spaced when affixed to the frame members, and in this way that the tracks are accurately parallel.

Preferably, the "one track" affixed in step (c) is the first track and the "other track" affixed in step (d) is the second track, so that each track is accurately located to the frame members.

Suitably, step (b) may involve resting the rails of the second track on a respective rail support structure provided on the first frame member, and step (d) may involve resting the rails of the other of said tracks on a respective rail support structure provided on the second frame member.

The invention further provides a method of manufacturing a printer comprising manufacturing a scan axis assembly in accordance with the invention, and mounting the assembly on a printer body.

BRIEF DESCRIPTION OF THE DRAWINGS

The invention will now be further illustrated by the following description of embodiments thereof, given by way of example only with reference to the accompanying drawings, in which.

DETAILED DESCRIPTION OF THE PREFERRED EMBODIMENTS

Figure 1:
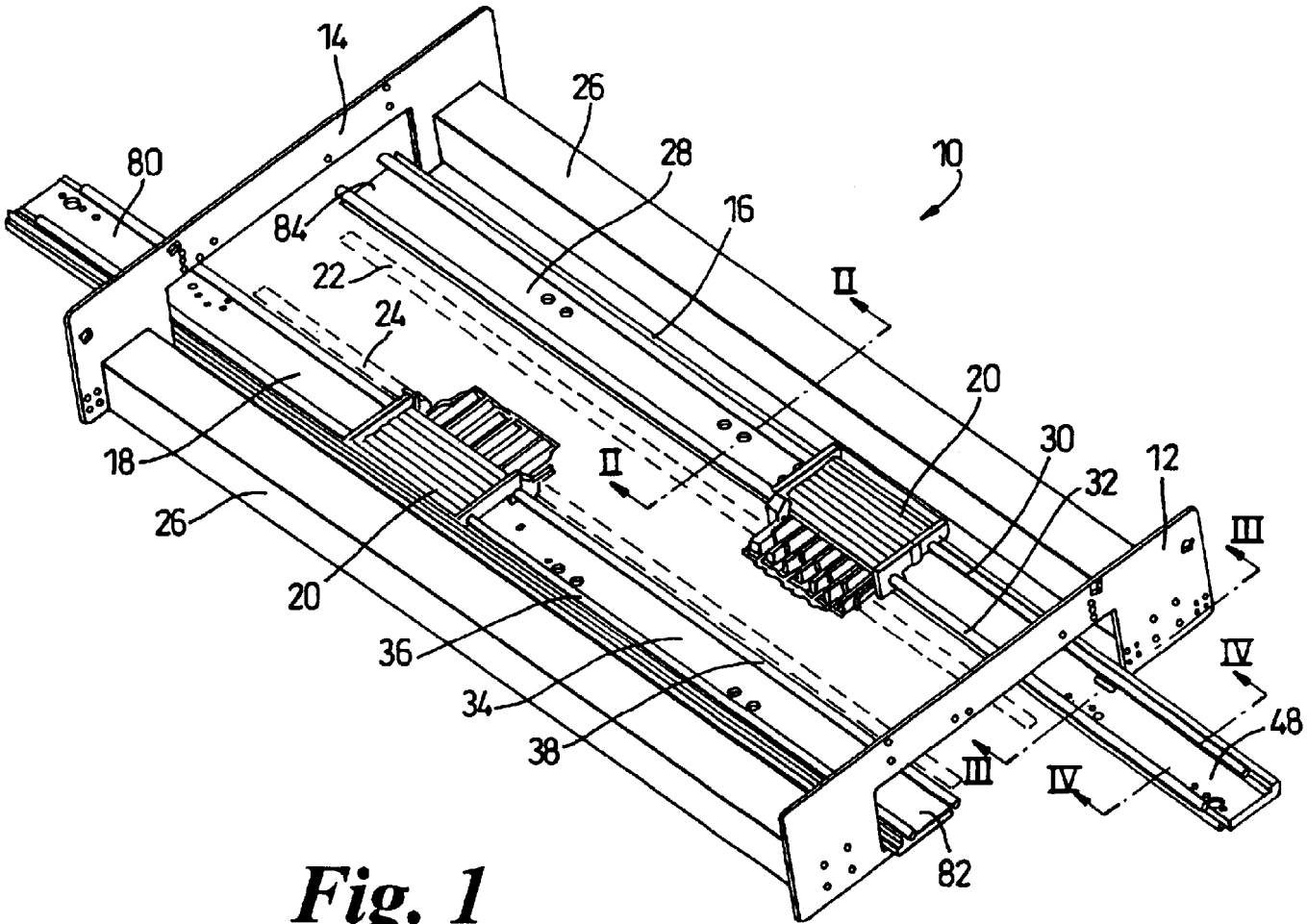
FIG. 1 is a perspective view of an embodiment of a scan axis assembly according to the invention.

In FIG. 1 there is indicated, generally at 10, an embodiment of a scan axis assembly according to the invention. The assembly comprises track support members 12 and 14, in the form of a first frame member 12 and a second frame member 14, spaced apart from one another along an axial direction defined by a first track 16 and a parallel second track 18.

The first and second tracks 16, 18 span the distance between the frame members 12,14 and they each have a print carriage 20 mounted thereon. The print carriages are conventional print carriages each mounting a set of six inkjet cartridges, and are driven by a carriage drive mechanism (not shown) when the assembly is mounted within a printer to traverse the tracks and thereby deposit a swath of ink along a respective one of two print zones 22,24, indicated in dotted outline.

When a print medium (e.g. a sheet of paper or a length of textile) is advanced under the assembly 10 by a print medium advance mechanism (not shown), it successively passes through the two print zones 22,24 and a swath of ink can be printed thereon by the print carriages.

Due to the separation between the print zones, ink laid down in the first print zone 22 will be relatively dry when the paper on which it has been printed reaches the second print zone 24 thus, the print mask of ink droplets can be divided between the print zones 22,24 to enable higher quality printing for a given number of passes as explained above.

Structural integrity of the assembly is ensured by a pair of longitudinally extending struts 26 affixed between the frame members 12,14.

Each track comprises three basic components, namely a rail support member and a pair of rails. Referring to track 16, the rail support member 28, outer rail 30 and inner rail 32 can be identified. Similarly, track 18 comprises a rail support member 34, inner rail 38 and outer rail 36. The rails are used to mount and guide the carriages by means of bushings on the carriages which engage and run along the rails in conventional manner.

Figure 2:
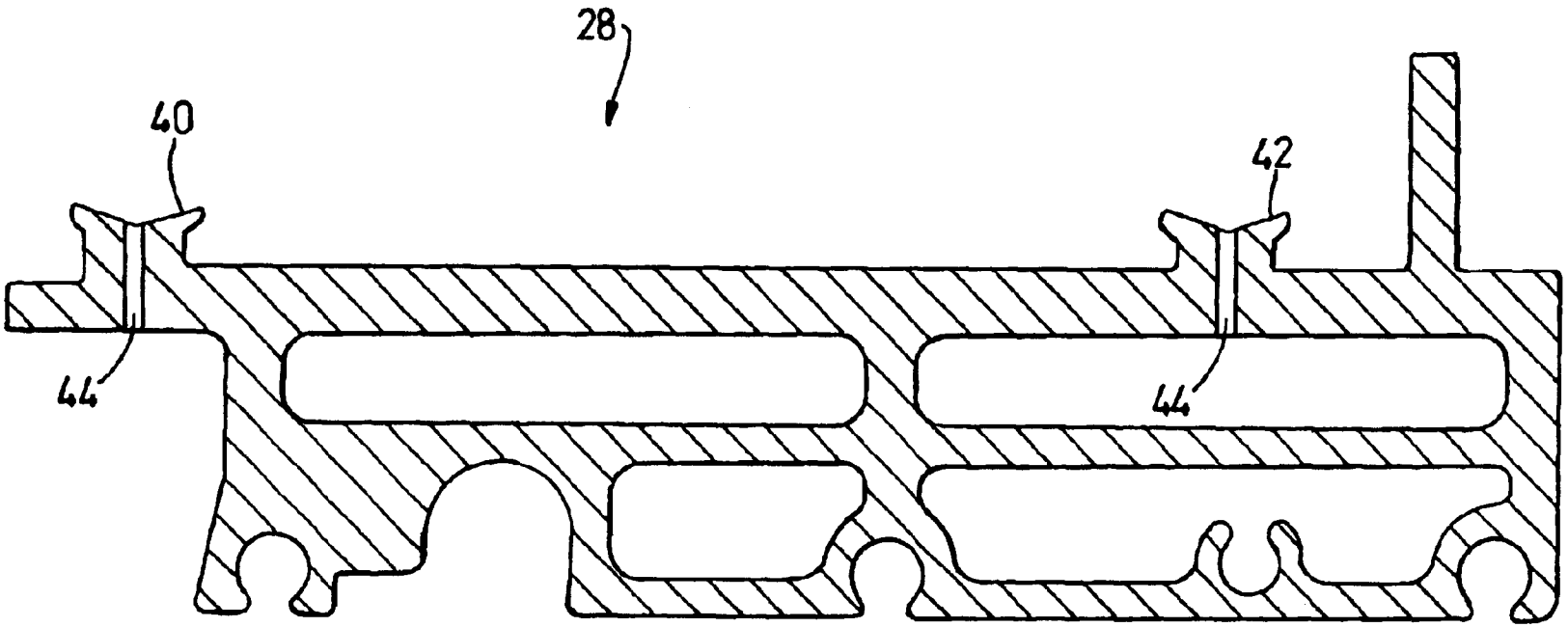
FIG. 2 is a sectional elevation of a rail support member of a track forming part of the assembly of FIG. 1, taken along the line II—II.

The rail support members 28,34 are manufactured as an aluminium extrusion. FIG. 2 shows rail support member 28 of track 16 in sectional elevation (as taken along the line II—II in FIG. 1), with the rails 30,32 omitted.

Rail support member 28 is formed as an aluminium extrusion with an inner "V"-shaped rail mounting feature 40 for mounting inner rail 32 (FIG. 1) and an outer "V"-shaped rail mounting feature 42 for mounting outer rail 30. Screw-receiving holes 44 are located at 180 mm intervals along the rail mounting features 40,42, and the rails, which are formed as circular-section steel bars, are similarly provided with threaded holes at 180 mm intervals. This enables the rails to be securely mounted to the rail mounting features and to conform to their straightness (counteracting any non-linearity in the rails).

The aluminium extrusion of the rail support member 28 has a tolerance of 1 mm per meter. However, after extrusion, the "V"-shaped features 40,42 are accurately machined to a tolerance of just under 0.1 mm per meter, so that for a 1.6 m length of track between the frame members (as shown in FIG. 1), the variation from linearity is only 0.15 mm. Furthermore, since the print carriage shown has a length of 250 mm, the expected mean variation from linearity within one carriage length is only 0.025 mm, ensuring that all of the pens on the carriage are able to deposit droplets correctly with respect to the adjacent droplets deposited by the other pens on the carriage. The printer can then be calibrated in known manner to account for the variation from non-linearity along the axis in the secure knowledge that the carriage, when moving along its own length, is moving in a straight line.

Figure 3:
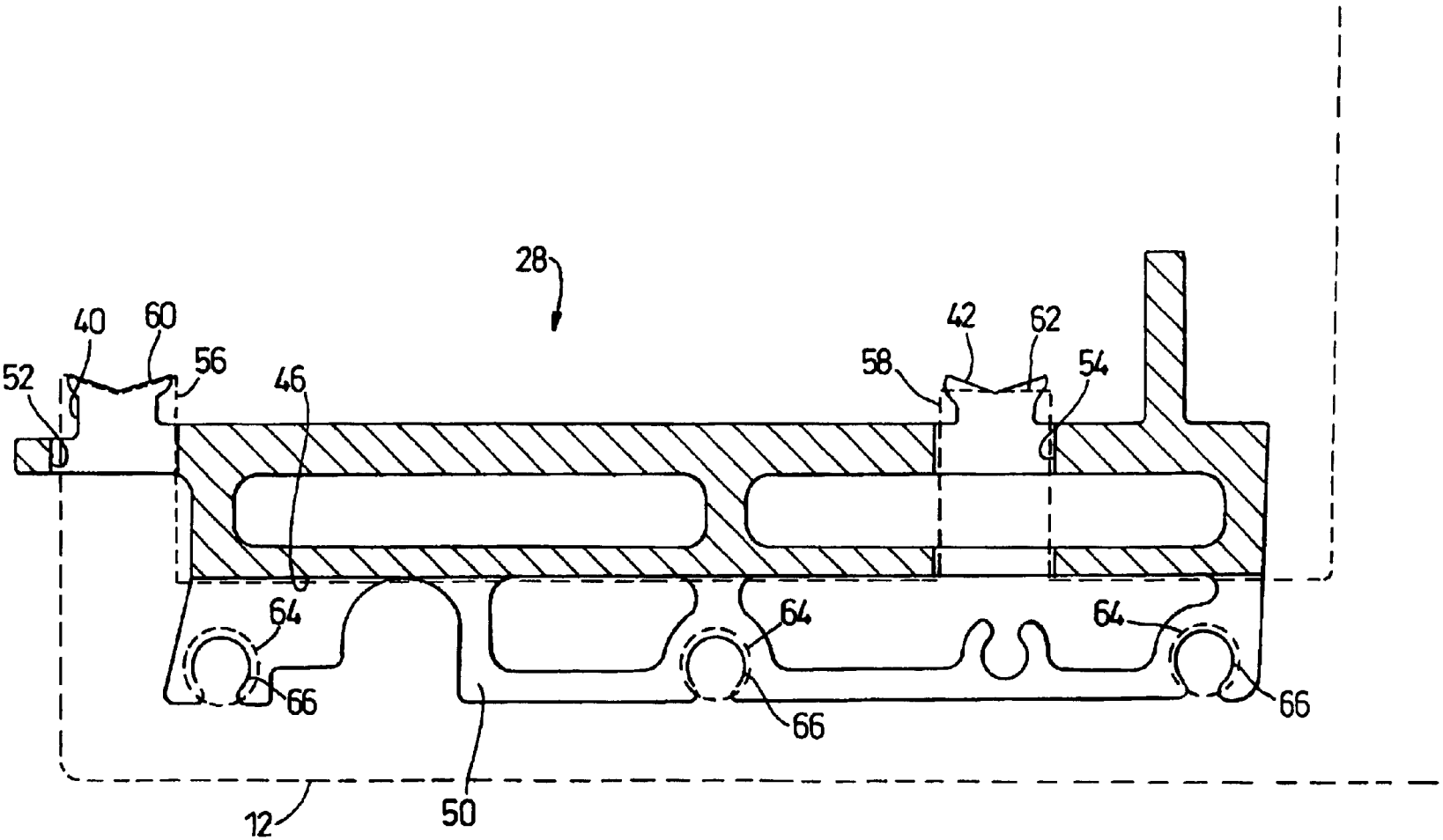
FIG. 3 is a sectional elevation of a rail support member of the track of FIG. 2, taken along the line III—III.

FIG. 3 shows the rail support member 28 at the point where it meets the frame member 12. At this location along the rail support member, the lower part of the extrusion is machined away to provide a bottom surface 46 for the remainder 48 (see FIG. 1) of the length of the extrusion extending beyond the frame member 12. The end surface 50 (FIG. 3) of the lower part of the extrusion 28 thus provides a step against which the frame member 12 (a portion of which is indicated in dotted outline) is located.

The rail support member extrusion has a first slot 52 and a second slot 54 machined up through the rail mounting features 40,42 to receive a first tab 56 and second tab 58 respectively of the frame member 12. First tab 56 has a "V"-shaped upper surface 60 which coincides with the "V"-shaped surface of the rail mounting feature 40. This means that when the inner rail 32 is in place on rail mounting feature 40, the rail 32 can be precisely positioned with respect to the frame member 12 by resting the rail 32 in the inner angle of the "V"-shaped upper surface 60.

The upper surface 62 of the second tab 58 is flat and not "V"-shaped, so that while it provides a rail support structure (i.e. a surface) for resting the outer rail 30, all of the location of track 16 is achieved by means of the location point provided by the surface 60 of tab 56.

In assembling the track 16 to the frame member 12, the tabs 56,58 are first fed through the slots 52,54, and the rails 30,32 (not shown in FIG. 3) are rested on the tabs. Due to the "V"-shaped profile of the upper surface 60, this uniquely positions the inner rail 32 and thus the entire track 16 with respect to the first frame member 12. A set of bolt receiving holes 64 in the frame member 12 are provided each of which allows a bolt to be fastened into a threaded section of a plurality of apertures 66 in the lower part of the extrusion, thereby fastening the first frame member 12 to the first track 16. The bolt receiving holes are slightly larger than the diameter of the shanks of the bolts themselves (but smaller than the heads of the bolts) to provide a small amount of play and ensure that the relative positions of the frame member and track are determined by the interaction between the inner rail 32 and the location point provided by the surface 60 of first tab 56.

Figure 4:
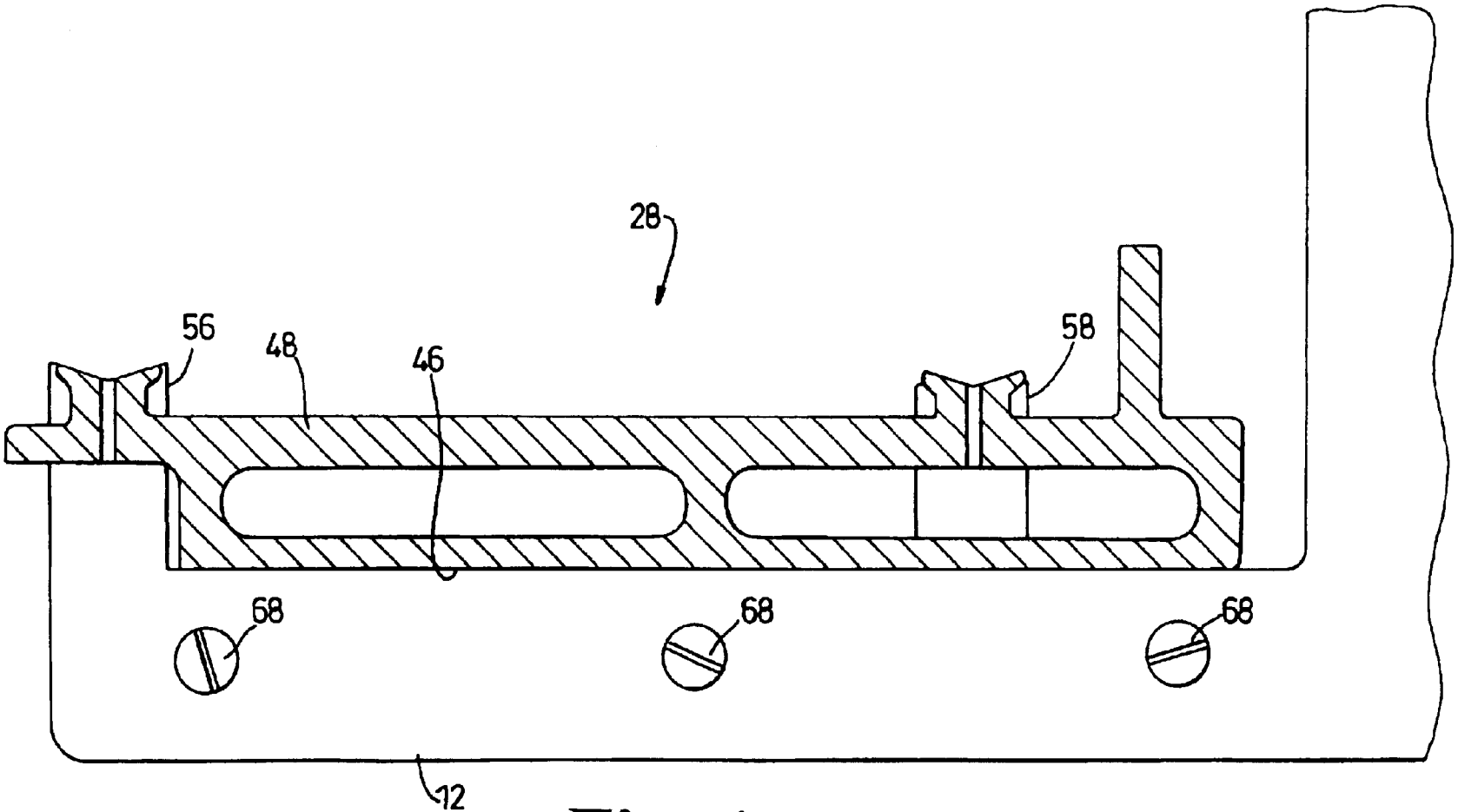
FIG. 4 is a sectional elevation of a rail support member of the track of FIG. 2, taken along the line IV—IV.

FIG. 4 shows the remainder 48 of rail support member 28 (see FIG. 1) in sectional elevation taken along the line IV—IV in FIG. 1. In this view, it can be seen that the extrusion has been machined away below the bottom surface 46 of the remainder 48. It can be seen that the frame member 12 (only a portion of which is shown) is affixed to the extrusion as described above by a set of bolts 68, and that the tabs 56,58 extend into the upper part of the extrusion at the point where the frame member and extrusion are affixed together.

The second track 18 is affixed to the first frame member 12 in a mirror image to that described for track 16 with two important exceptions.

Figure 5:
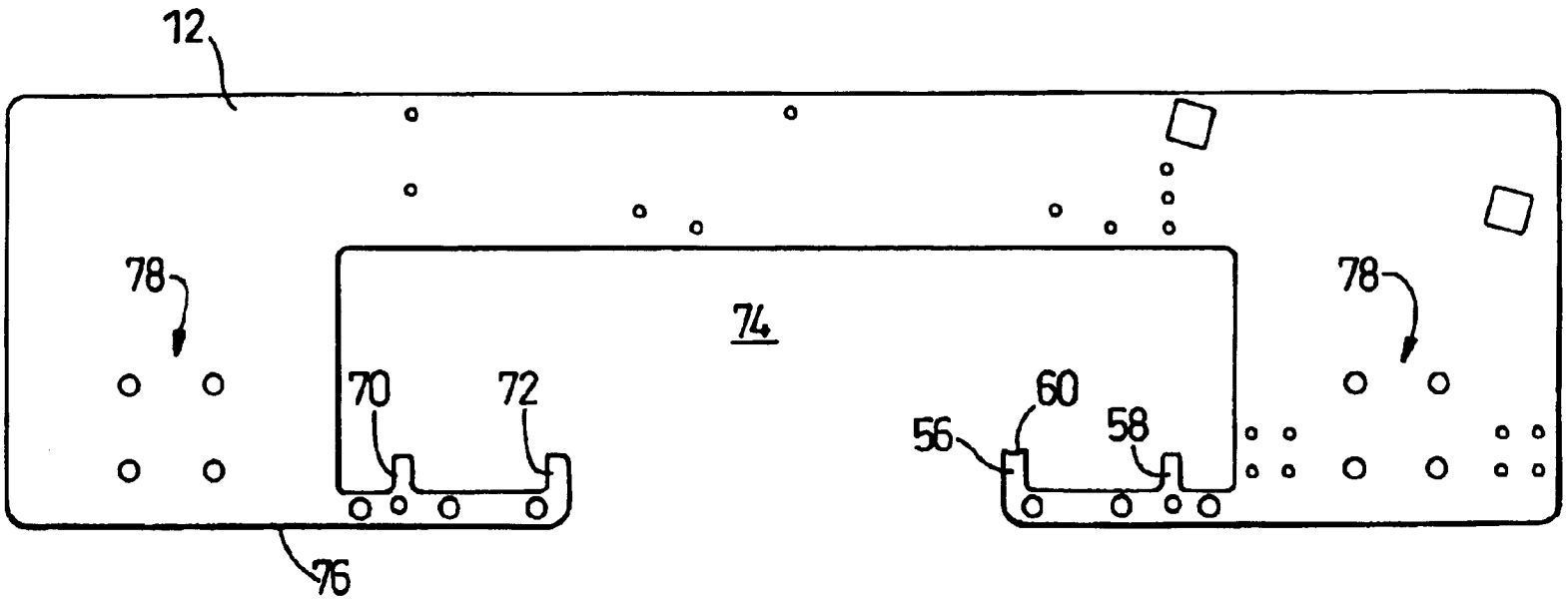
FIG. 5 is an elevation of a frame member forming part of the assembly of FIG. 1, shown before assembly.

First, referring to FIG. 5, which shows frame member 12 in elevation, the tabs extending 70, 72 which extend up into slots created through rail support member 34 of track 18 are both provided with flat upper surfaces (i.e. of the four tabs 56,58,70,72, only upper surface 60 of tab 56 is "V"-shaped as a location point, while the other tabs merely provide rail support structures on which the rails 30,36,38 rest.

Second, as can be seen with reference to FIG. 1, the second track 18 extends past the first frame member 12 to a far lesser extent than track 16. Conversely, the mounting at the opposite end of the assembly 10 is a mirror image under point symmetry: Second track 18 extends past second frame member 14 to a far greater extent than first track 16 does.

Because of this central symmetry, the extended part 48 of first track 16 enables the carriage 20 mounted on that track to be traversed along the track and outside of first frame member 12, while an identical extended portion 80 (FIG. 1) of second track 18 allows the carriage 20 mounted on track 18 to be traversed past second frame member 14. Since second track 18 only extends a short distance past first frame member 12, there is a space provided adjacent the unextended end 82 of second track 18 for maintenance of the carriage on first track 16, and there is a matching space provided adjacent the unextended end 84 of first track 16 for maintenance of the carriage on second track 18, when the assembly 10 is mounted in a printer. In this space a printhead cleaning mechanism may be located to service the carriage when it moves alongside, and it also allows access to the carriage for maintenance or replacement of the carriage or of the print cartridges on the carriage.

As also seen in FIG. 5, the frame member 12 is in the form of a generally "C"-shaped plate (rotated through 90 degrees in the orientation shown), with a central aperture 74 which is open to the external periphery 76 of the plate. FIG. 5 also shows two sets of mounting points, each indicated generally at 78 and having four mounting points which are used to mount the reinforcing struts 26 (FIG. 1) after the frame members 12,14 and tracks 16,18 have been assembled together.

Figure 6:
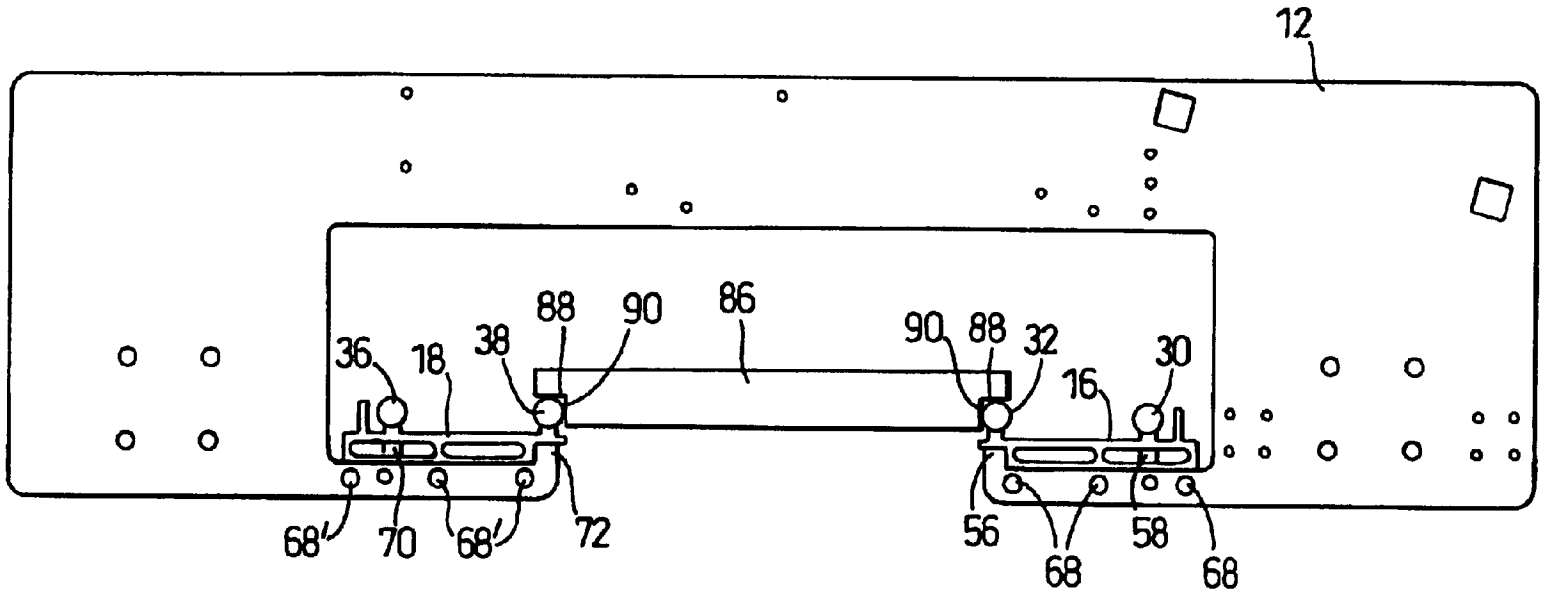
FIG. 6 is an elevation of the frame member of FIG. 5, shown during assembly.

FIG. 6 shows first frame member 12 during the assembly of the tracks 16,18 to the frame member 12. As previously described, the outer and inner rails 30,32 of track 16 are rested on the tabs 56,58 of the frame member 12, causing the "V"-shaped surface 60 (see FIG. 5) to locate the first track 16 precisely on the frame member. At this point the bolts 68 are inserted and tightened, affixing first track 16 in position.

The second track is then placed in approximate position with the outer and inner rails 36,38 of track 18 resting on the tabs 70,72 of the frame member 12. Because of the flat upper surfaces of these tabs the second track can be moved from side to side as required. By placing the frame member flush with the surface revealed by machining away the lower part of rail support member 34 of track 18 (i.e. the surface which is equivalent to surface 50 (FIG. 3) but at the opposite end), the two tracks are known to be generally parallel. The precise spacing between the inner rail 32 of first track 16 and the inner rail 38 of second track 18 is then adjusted with reference to a hardened steel template 86.

Template 86 has a pair of co-planar surfaces 88 which are adapted to rest on the tops of the inner rails 32,38 and a pair of parallel, spaced-apart shoulders 90 which allow the inner rail 38 of second track 18 to be spaced a precisely predetermined distance from the inner rail 32 of first track 16.

With the inner rails and template 86 touching in this way, the second track 18 can be affixed to the first frame member 12 with a set of bolts 68'.

The second frame member 14 (FIG. 1) is then attached in identical manner to the first track 16 (which locates precisely by inner rail 32 resting in the angle of a "V"-shaped tab) and the second track 18 (which is spaced from the first track 16 at the location of second frame member 14 by means of the template 86).

Since the template 86 provides a precise spacing between the inner rails 32,38 at two points along their lengths, these inner rails are parallel to one another. Furthermore, since the inner and outer rails on each track are tightly mounted on the precisely machined rail mounting features 40,42, all four rails can be assumed to be very close to truly parallel. This means that the carriage traversing first track 16 and the carriage traversing second track 18 will define a pair of parallel print zones 22,24. Thus, a print mask in which the droplets for any given area are distributed between the two print zones can be reliably printed by both carriages to provide an accurate final image.

Figure 7:
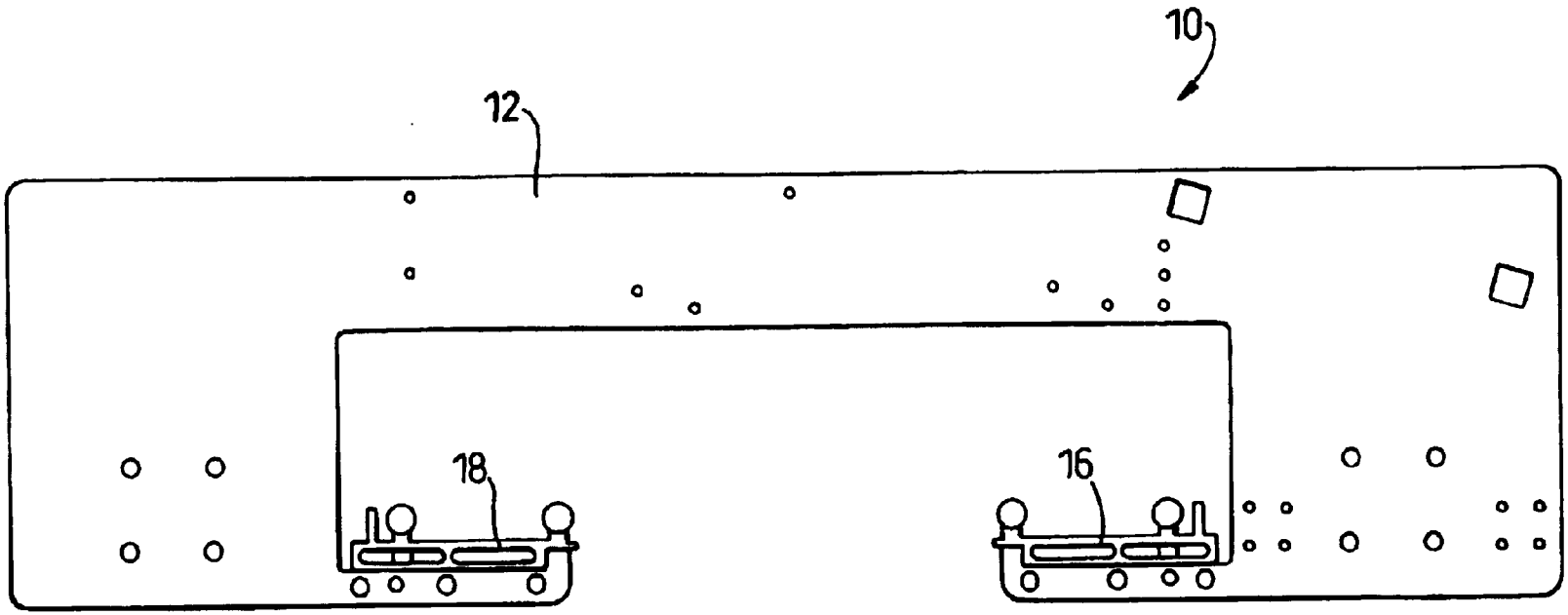
FIG. 7 is an elevation of the frame member of FIG. 6, shown after assembly.

The template is used only in the assembly of the components. FIG. 7 shows the scan axis assembly 10 as viewed from an end with first frame member shown in elevation and first and second tracks 16,18 affixed thereto. The scan axis assembly is finally mounted in the body of a printer and the various other printer components, including control circuitry for the two carriages, carriage drive mechanisms, paper advance mechanism, etc. also assembled in the printer body with respect to the assembly to provide a twin scan axis printer.

It will be appreciated that while the embodiment shown has two opposed print carriages located in mirror symmetry to one another on a pair of rails so that the respective print zones are closely spaced from one another, different mounting arrangements and/or spacings are possible.

The invention is not limited to the embodiments described herein which may be varied without departing from the spirit of the invention.

What is claimed is:

1. A scan axis assembly for a printer comprising first and second tracks, the tracks being rigidly located relative to one another by one or more track support members, and each track comprising a rail support member and at least one rail mounted on the rail support member to support a print carriage such that the print carriage may move along the rail to traverse a print zone, wherein two or more rails are mounted on the rail support member of each track, and wherein each frame member comprises a locating point for accurately locating one rail of one track to the frame member.

2. A scan axis assembly as claimed in claim 1, wherein said one or more track support members comprise a pair of frame members spaced apart from one another along a scan axis direction, said first and second tracks spanning said frame members and lying along said scan axis direction parallel to one another, whereby said frame members maintain the spacing between said parallel tracks when assembled in a printer.

3. A scan axis assembly as claimed in claim 1, wherein each frame member comprises means for adjustably affixing the tracks to the frame member, whereby when said one rail of one track is located at the locating point the distance between the tracks can be adjusted before the other track is affixed to the frame member.

4. A scan axis assembly as claimed in claim 3, wherein said one rail of one track is located at the locating point of each frame member, and the other track is affixed to each frame member when it has been positioned a predetermined distance from said one track.

5. A scan axis assembly as claimed in claim 1, wherein the locating point comprises a "V"-shaped recess which receives said rail.

6. A scan axis assembly as claimed in claim 1, wherein each frame member comprises a support structure for supporting each of the rails not located at said locating point.

7. A scan axis assembly as claimed in claim 6, wherein each frame member comprises a plate having a central aperture for receiving said tracks, said locating point and said support structures extending into said aperture for receiving the rails, and means for affixing the rail support members of the tracks to the opposed internal faces of the plates when the rails are located on the locating point and the support structures.

8. A scan axis assembly as claimed in claim 7, wherein said plate is generally "C"-shaped such that the aperture is open to the external periphery of the plate.

9. A scan axis assembly as claimed in claim 8, wherein one end of each track extends beyond one of the frame members by a distance at least equal to the width of the carriage, whereby the carriage may be traversed along the track past the frame member to allow access to or maintenance of the carriage.

10. A scan axis assembly as claimed in claim 9, wherein the first and second tracks extend beyond the frame members as aforesaid at opposite ends.

11. A scan axis assembly as claimed in claim 10, wherein the first and second tracks are provided with stops against which the frame members are mounted.

12. A scan axis assembly for a printer comprising first and second tracks, the tracks being rigidly located relative to one another by one or more track support members, and each track comprising a rail support member and at least one rail mounted on the rail support member to support a print carriage such that the print carriage may move along the rail to traverse a print zone, wherein two or more rails are mounted on the rail support member of each track, and wherein the rail support members of the tracks are manufactured to a first tolerance below that required for accurate positioning of a print carriage in use, but comprise a rail mounting feature manufactured to a second tolerance at least equal to that required for accurate positioning of a print carriage in use, the rails being affixed to the rail mounting feature and the rails being adapted to receive the print carriage.

13. A scan axis assembly as claimed in claim 12, wherein the rail mounting feature comprises a pair of parallel accurately machined grooves on each rail support member, each groove being adapted to receive a respective rail of the track.

14. A printer comprising:

a printer body; and a scan axis assembly mounted on the printer body, the scam axis assembly including first and second tracks, the tracks being rigidly located relative to one another by one or more track support members, and each track comprising a rail support member and at least one rail mounted on the rail support member to support a print carriage such that the print carriage may move along the rail to traverse a print zone, wherein two or more rails are mounted on the rail support member of each track, and wherein each frame member comprises a locating point for accurately locating one rail one track to the frame member.

15. A printer as claimed in claim 14, wherein said one or more track support members comprise a pair of frame members spaced apart from one another along a scan axis direction, said first and second tracks spanning said frame members and lying along said scan axis direction parallel to one another, whereby said frame members maintain the spacing between said parallel tracks when assembled in a printer.

16. A printer as claimed in claim 14, wherein each frame member comprises means for adjustably affixing the tracks to the frame member, whereby when said one rail of one track is located at the locating point the distance between the tracks can be adjusted before the other track is affixed to the frame member.

17. A printer as claimed in claim 16, wherein said one rail of one track is located at the locating point of each frame member, and the other track is affixed to each frame member when it has been positioned a predetermined distance from said one track.

18. A printer as claimed in claim 14, wherein the locating point comprises a "V"-shaped recess which receives said rail.

19. A printer as claimed in claim 14, wherein each frame member comprises a support structure for supporting each of the rails not located at said locating point.

20. A printer as claimed in claim 19, wherein each frame member comprises a plate having a central aperture for receiving said tracks, said locating point and said support structures extending into said aperture for receiving the rails, and means for affixing the rail support members of the tracks to the opposed internal faces of the plates when the rails are located on the locating point and the support structures.

21. A printer as claimed in claim 20, wherein said plate is generally "C"-shaped such that the aperture is open to the external periphery of the plate.

22. A printer as claimed in claim 21, wherein one end of each track extends beyond one of the frame members by a distance at least equal to the width of the carriage, whereby the carriage may be traversed along the track past the frame member to allow access to or maintenance of the carriage.

23. A printer as claimed in claim 22, wherein the first and second tracks extend beyond the frame members as aforesaid at opposite ends.

24. A printer as claimed in claim 23, wherein the first and second tracks are provided with stops against which the frame members are mounted.

25. A printer as claimed in claim 14, further comprising a print medium advance mechanism for advancing a print medium past the scan axis assembly, and a print carriage traverse mechanism for causing a pair of print carriages mounted on the tracks of the scan axis assembly to traverse the tracks and thereby enable the printing of swaths on the print medium.

26. A printer comprising:

a printer body; and a scan axis assembly mounted on the printer body, the scan axis assembly including first and second tracks, the tracks being rigidly located relative to one another by one or more track support members, and each track comprising a rail support member and at least one rail mounted on the rail support member to support a print carriage such that the print carriage may move along the rail to traverse a print zone, wherein two or more rails are mounted on the rail support member of each track, and wherein the rail support members of the tracks are manufactured to a first tolerance below that required for accurate positioning of a print carriage in use, but comprise a rail mounting feature manufactured to a second tolerance at least equal to that required for accurate positioning of a print carriage in use, the rails being affixed to the rail mounting feature and the rails being adapted to receive the print carriage.

27. A printer as claimed in claim 26, wherein the rail mounting feature comprises a pair of parallel accurately machined grooves on each rail support member, each groove being adapted to receive a respective rail of the track.

28. A method of manufacturing a scan axis assembly for a printer, comprising the steps of:

a) affixing a first linear track adapted to receive a print carriage to first frame member;

b) affixing a second linear track adapted to receive a print carriage to said first frame member such that the points of attachment of the tracks to the first frame member are separated by a predetermined distance and the tracks are positioned generally parallel to one another;

c) affixing one of the first and second tracks to a second frame member such that the first and second frame members are spaced apart from one another along the direction of the tracks; and d) affixing the other of the first and second tracks to the second frame member such that the points of attachment of the tracks to the second frame member are separated by said predetermined distance and the tracks are accurately positioned parallel to one another to define parallel scan axes for a pair of print carriages each mounted on a respective one of said tracks, wherein each track comprises a rail support member and at least one rail mounted on the rail support member, and wherein step (a) comprises locating one rail of the first track at a locating point provided on the first frame member prior to affixing the first track to the first frame member.

29. A method as claimed in claim 28, wherein step (b) comprises employing a spacing template to separate the second track from the first track by said predetermined distance before affixing the second track to the first frame member.

30. A method as claimed claim 29, wherein step (c) comprises locating one rail of said one of the tracks at a locating point provided on the second frame member prior to affixing said one of said tracks to the second frame member.

31. A method as claimed in claim 30, wherein step (d) comprises employing a spacing template to separate said other track from said one track by said predetermined distance before affixing said other track to the second frame member.

32. A method as claimed in claim 30, wherein said one track affixed in step (c) is the first track and said other track affixed in step (d) is the second track.

33. A method as claimed claim 28, wherein the locating point comprises a "V"-shaped recess which receives said rail.

34. A method as claimed in claim 28, wherein step (b) comprises resting the at least one rail of the second track on a respective support structure provided on the first frame member.

35. A method as claimed in claim 28, wherein step (d) comprises resting the at least one rail of the other of said tracks on a respective support structure provided on the second frame member.

36. A method of manufacturing a scan axis assembly for a printer, comprising the steps of:

a) affixing a first linear track adapted to receive a print carriage to a first frame member;

b) affixing a second linear track adapted to receive a print carriage to said first frame member such that the points of attachment of the tracks to the first frame member are separated by a predetermined distance and the tracks are positioned generally parallel to one another;

c) affixing one of the first and second tracks to a second frame member such that the first and second frame members are spaced apart from one another along the direction of the tracks; and d) affixing the other of the first and second tracks to the second frame member such that the points of attachment of the tracks to the second frame member are separated by said predetermined distance and the tracks are accurately positioned parallel to one another to define parallel scan axes for a pair of print carriages each mounted on a respective one of said tracks, and wherein each frame member comprises a plate having a central aperture for receiving said tracks, and the tracks are affixed to opposed internal faces of the plates.

37. A method as claimed in claim 36, wherein each track comprises a rail support member and at least one rail mounted on the rail support member.

38. A method as claimed in claim 36, wherein said plate is generally "C"-shaped such that the aperture is open to the external periphery of the plate.

39. A method as claimed in claim 38, wherein the steps of affixing the frame members to the tracks include locating the frame members against stops provided on the tracks.

40. A method of manufacturing a printer comprising manufacturing a scan axis assembly as claimed in claim 39, and mounting the assembly on a printer body.

41. A method as claimed in claim 38, comprising the further steps of assembling in the printer body a print medium advance mechanism for advancing a print medium past the scan axis assembly, and a print carriage traverse mechanism for causing a pair of print carriages mounted on the tracks of the scan axis assembly to traverse the tracks and thereby enable the printing of swaths on the print medium.

* * * * *